United States Patent [19]

Youngblood

[11] 4,022,398

[45] May 10, 1977

[54] HOSE REEL

[76] Inventor: John W. Youngblood, 3201 Franklin, Waco, Tex. 76710

[22] Filed: Dec. 22, 1975

[21] Appl. No.: 643,299

[52] U.S. Cl. ..... 242/96; 242/86

[51] Int. Cl.[2] ..... B65H 75/40

[58] Field of Search ..... 242/86, 75, 85, 96, 242/71.8, 71.8 A, 115, 116, 77, 77.1

[56] References Cited

UNITED STATES PATENTS

| | | | |
|---|---|---|---|
| 983,795 | 2/1911 | Youngren | 242/106 |
| 1,799,748 | 4/1931 | Hayden | 242/74 |
| 2,189,547 | 2/1940 | Fischer | 242/74 X |
| 2,393,613 | 1/1946 | Combs | 242/96 |
| 2,805,100 | 9/1957 | Shaver | 242/86 X |
| 3,143,316 | 8/1964 | Shapiro | 242/96 |

*Primary Examiner*—Edward J. McCarthy
*Attorney, Agent, or Firm*—Howard E. Moore; Gerald G. Crutsinger

[57] ABSTRACT

An improved reel for winding elongated members, such as a garden hose, electrical cord or rope, onto a hollow cylinder having a central bore and a slotted cylinder wall to form a passage for retaining a first end of the elongated member. Spaced discs are secured to the cylinder and apertures formed in the periphery of each disc are circumferentially spaced relative to the apertures formed in the other disc, the apertures being adapted to engage and retain the second end of the elongated member. Handles are rotatably secured eccentrically from the central axis of the reel such that the reel may be rotated to wind an elongated member onto the hollow cylinder.

15 Claims, 5 Drawing Figures

HOSE REEL

BACKGROUND OF THE INVENTION

In today's mobile society, people are using recreational vehicles more and more in their travel. These recretional vehicles are many times self-contained such that they require a water source and source of electrical power for the modern conveniences and appliances that are built into the vehicle. To supply water to the recreational vehicle, a hose must be connected from the vehicle to a source of water such as a hydrant. Heavy duty extension cords are connected from the vehicle to sources of power which are provided in most of the modern trailer courts and parks.

The extension cords and hoses become bulky and inconvenient to store when not in use and may become entangled if not stored properly.

In addition, many garden hoses and extension cords, periodically used in the home, often become entangled when stored and become damaged when kinked.

Heretofore, reels have been bulky and not readily adaptable for expeditiously winding different types of elongated members such as garden hoses, extension cords, or ropes. For example, reels of the type disclosed in U.S. Pat. Nos. 1,017,532; 2,393,613; 2,508,809; 2,704,190; 3,330,498; and 3,779,478 were of unduly complicated construction, were not easily manipulated by senior citizens and children, and did not provide anchorage for both ends of a garden hose or extension cord stored thereon.

SUMMARY

I have devised a hose reel comprising a hollow cylindrical member having a cylinder wall and a central bore with a passage formed in the hollow cylindrical member communicating with the central bore. A first end of an elongated member, such as hose or extension cord, is positionable through the passage to retain or anchor the end of the elongated member relative to the cylindrical member.

First and second flanges are formed on opposite ends of the hollow cylindrical member and apertures, circumferentially spaced about the periphery of the flanges, are formed through each flange such that the apertures are alternately spaced on opposite sides of the reel providing an anchor means for the second end of the elongated member.

Flat handles are rotatably eccentrically secured relative to the longitudinal axis of the hollow cylindrical member such that the handles may be held in the hand and rotated to wind the elongated member about the hollow cylindrical member.

A primary object of the invention is to provide a portable reel of lightweight construction particularly adapted to expedite storage of garden hose, electrical extension cords, ski ropes and similar elongated members wherein both ends of the elongated member are detachably secured to the reel.

Another object of the invention is to provide a reel having handles rotatably secured to opposite ends of the reel, the handles being positioned to facilitate supporting and rotating the reel to take up or dispense an elongated member such as a garden hose, electrical extension cord, or rope.

A further object of the invention is to provide a reel of compact design which is readily storable in a flat narrow space in a recreational vehicle.

A still further object of the invention is to provide a reel which is readily adapted for storage of different lengths of an elongated member wherein both ends of the elongated member are anchored to the reel.

A still further object of the invention is to provide a simple hose reel which may be inexpensively constructed making use of the reel economically feasible for recreational and domestic purposes.

A still further object of the invention is to provide a hose reel which may be rotated about a central axis without necessity of a reel stand.

Other and further objects of the invention will become apparent upon studying the detailed description and drawings annexed hereto.

DESCRIPTION OF THE DRAWINGS

Drawings are annexed hereto so that the invention may be better and more fully understood, in which.

Numeral references designate parts in the drawings and like numbers designate like parts throughout the various figures of the drawings.

DESCRIPTION OF A PREFERRED EMBODIMENT

Figure 1:
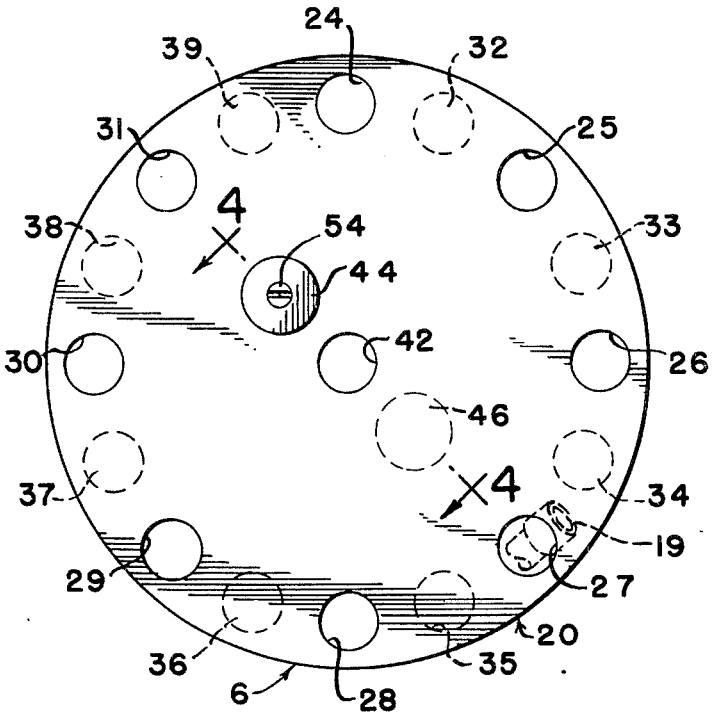
FIG. 1 is a front elevational view of the hose reel.
Figure 2:
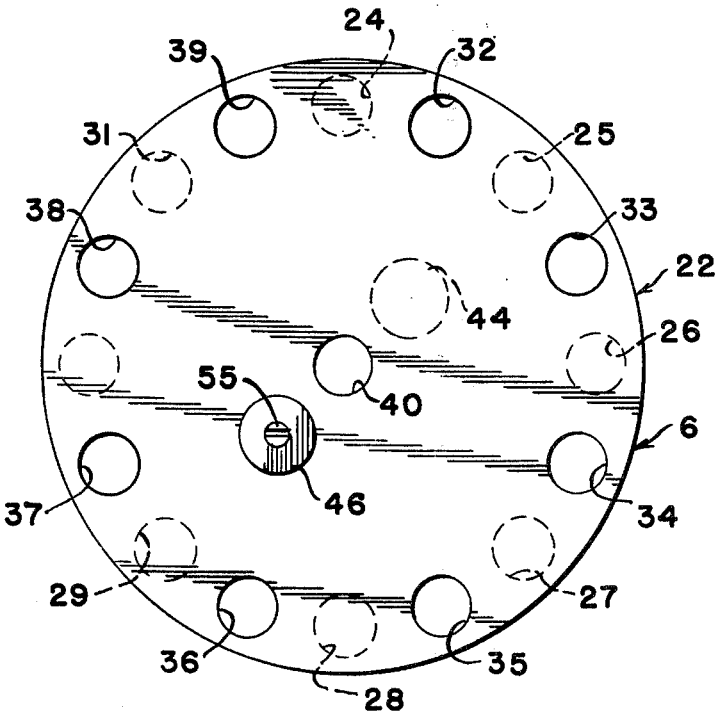
FIG. 2 is a rear elevational view.
Figure 3:
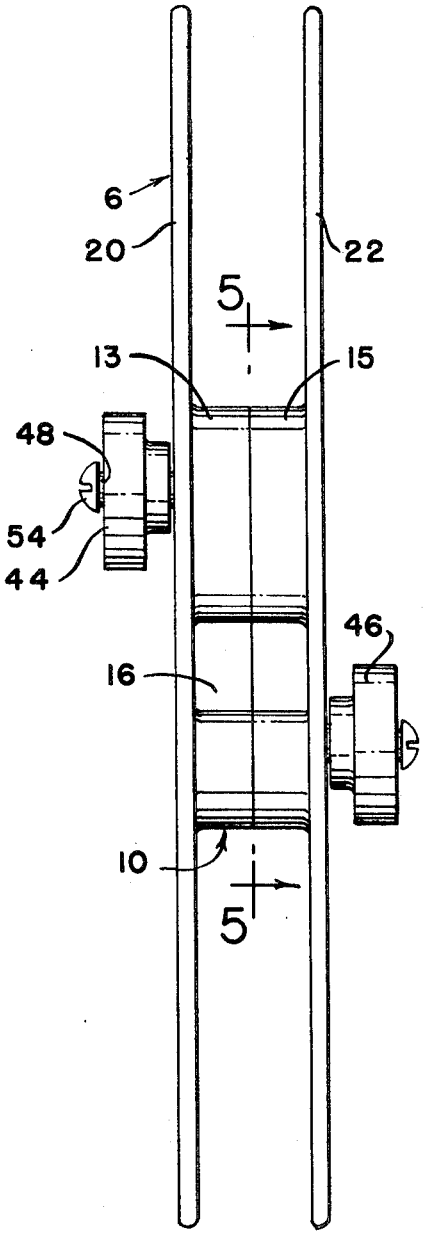
FIG. 3 is a side elevational view thereof.
Figure 4:
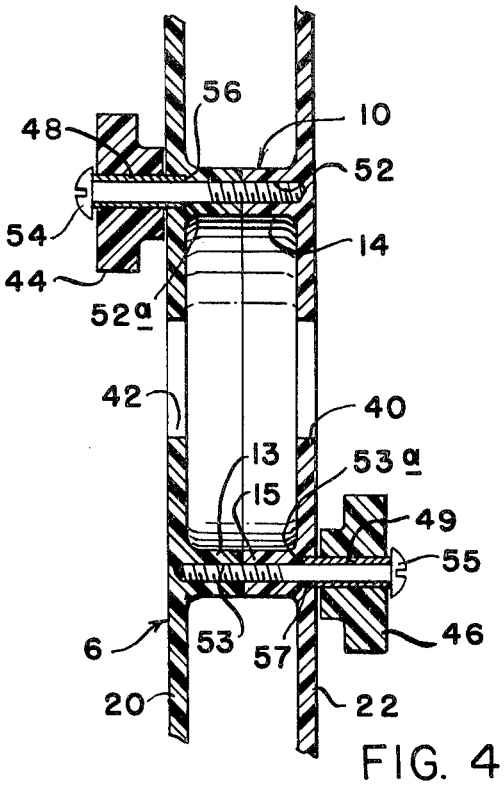
FIG. 4 is a cross-section view taken along line 4—4 of FIG. 1.
Figure 5:
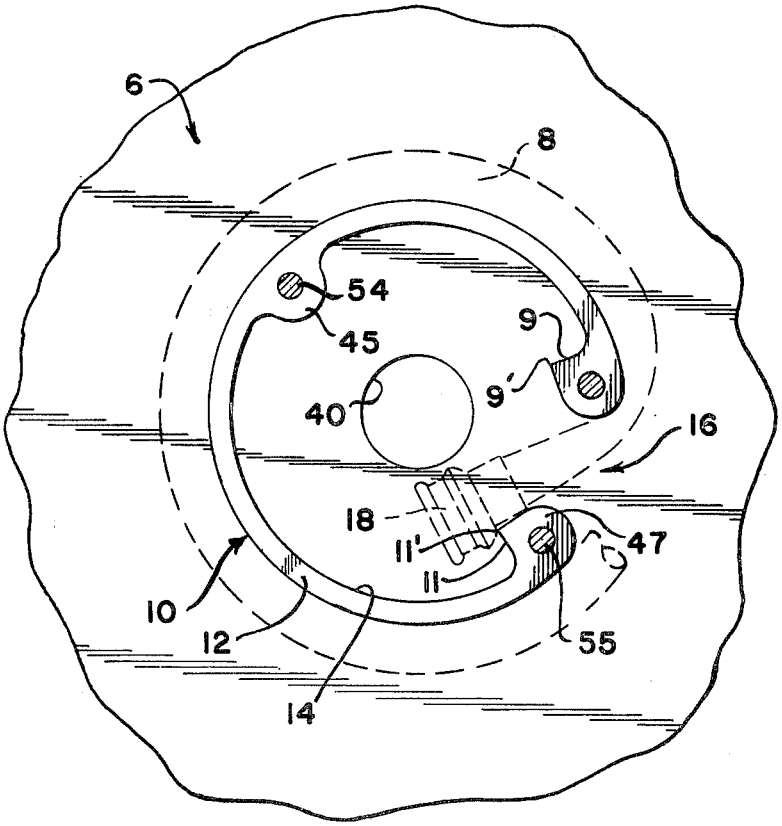
FIG. 5 is a cross-sectional view taken along 5—5 of FIG. 3.

Referring to FIGS. 1–5 of the drawings, the numeral 6 generally designates a hose reel for storing an elongated member such as a garden hose 8, partially illustrated in FIG. 5.

The reel 6 comprises a hollow cylindrical member 10 having a cylinder wall 12 composed of substantially identical segments 13 and 15 with a central bore 14 formed therein. The cylinder wall 12 has an elongated slot forming passage 16 formed therein communicating with the central bore 14 of the hollow cylindrical member 10. Ribs 9 and 11 are secured to the inner surfaces of cylinder wall 12 adjacent opposite sides of passage 16.

Passage 16 is adapted to receive a first end 18 of elongated member 8 and ribs 9 and 11 are wedge-shaped, each terminating in a sharp apex 9' and 11' respectively, to engage and retain the end 18 of elongated member 8 to facilitate winding the hose 8 about the hollow cylindrical member 8, as best illustrated in FIG. 5.

The reel 6 has first and second flanges comprising circular discs 20 and 22 formed on each side of said hollow cylindrical member 10.

Anchor means such as apertures 24, 25, 26, 27, 28, 29, 30 and 31 are circumferentially spaced adjacent the periphery of disc 20 to receive and anchor the second end 19 of elongated member 8 when wound on the reel 6. Apertures 32, 33, 34, 35, 36, 37, 38 and 39 are circumferentially spaced adjacent the periphery of disc 22 to provide anchor means on the opposite side of the reel and are spaced between the apertures formed in disc 20. The apertures 24–31 on disc 20 being spaced circumferentially about the axis of the reel 6 relative to apertures 32–39 formed in disc 22 provide anchor means for the end 19 of hose 8 about substantially the entire circumference of discs 20 and 22, thus, accommodating various lengths of hose.

It should be readily apparent from the foregoing that the second end 19 of the elongated member 8 may be inserted through any one of the sixteen apertures and is retained thereby. Alternate anchor means (not shown) include a slot cut from the periphery of discs 20 and 22 into which the end 19 of hose 8 would be insertable.

Central openings 40 and 42, formed in discs 20 and 22, communicate with the central bore 14 of the hollow cylindrical member 10 to aid in positioning end 18 of elongated member 8 against one of ribs 9 or 11. A shaft (not shown) may be inserted through passages 40 and 42 for rotation of the reel 6 thereon. Apertures 24–39 provide a means for hanging the reel in a storage area if so desired.

Bosses 45 and 47 are diametrically formed on the interior of segments 13 and 15 of cylinder wall 12 such that passages 52 and 53 may be formed in segments 13 and 15 of cylinder wall 12.

Means for rotating reel 6 comprises handles 44 and 46 rotatably secured to hollow sleeves 48 and 49 which extend into counterbores **52*a* and 53*a* in passages 52 and 53 forming shoulders 56 and 57 to abut the ends of sleeves 48 and 49. Shoulders 56 and 57 limit longitudinal movement of sleeves 48 and 49 when sleeves 48 and 49 are urged inwardly by lag screws 54 and 55, thus preventing tightening of screws 54 and 55 against surfaces of handles 44 and 46 which would prevent rotation of the handles. Screws 54 and 55 function as stub shafts upon which handles 44 and 46** are rotatably disposed.

Handles 44 and 46 are spaced on opposite sides of the hollow cylindrical member 10 and diametrically positioned about central apertures 40 and 42 such that the reel 6 may be rotated about the central axis of hollow cylindrical member 10 while grasping each handle 44 and 46. Preferably handles 44 and 46 are radially spaced approximately one-third the distance between the central axis and the outer periphery of discs 20 and 22 to facilitate rotation of the reel 6 without exerting forces which would move the periphery of reel 6 laterally.

It should be readily apparent that due to the symmetric design of segments 13 and 15 that a spacer element (not shown) may be inserted between segments 13 and 15 to lengthen hollow cylindrical member 10, making the reel 6 wider. Lag screws 54 and 55 would have to be longer to reach the other side.

The handles 44 and 46 are preferably relatively flat knobs such that several reels 6 may be stacked one on top of the other on a shelf or the like. In addition, the knobs would provide a narrow body such that the reel 6 may be stored in a narrow area if desired. Other means such as brads, rivets, bolts or the like may be used to secure handles 44 and 46 to opposite sides of reel 6 if it is deemed expedient to do so.

Operation of the hereinbefore described device is as follows:

End 18 of an elongated member 8 such as the female hose coupling or female plug of an electrical cord is inserted through passage 16 in hollow cylindrical member 10.

Handles 44 and 46 are grasped by the user and rotated about the central axis, extending through central openings 40 and 44, winding the elongated member 8 about the hollow cylindrical member 10 between discs 20 and 22. The second end 19 of the elongated memeber 8 is inserted through the nearest apertures 24–39 to restrain the second end 19 of the elongated member 8 from unwinding when wound completely onto reel 6.

The process is reversed for removing the elongated member 8 from reel 6 by removing end 19 extending through one of the apertures 24–39, grasping handles 44 and 46, and reversing the direction of rotation from the direction on which the elongated member 8 was wound onto the reel 6. End 18 of the member 8 is then removed from the passage 16 formed in hollow cylindrical member 10.

When not in use the reel 6 may be stored in a flat position or in a narrow compartment in a recreational vehicle or laid flat on a shelf or hung upon a screw or nail.

It should be apparent from the foregoing that the objects of the invention hereinbefore discussed have been accomplished.

It should be readily apparent that other and further embodiments of the invention may be devised without departing from the basic concept thereof.

Having described my invention, I claim:

1. A reel onto which an elongated member is wound comprising; a hollow cylindrical member having a cylinder wall and a central bore, said hollow cylindrical member having a passage formed in the cylinder wall, said passage communicating with said central bore, a first end of the elongated member being positionable through said passage; first and second flange elements secured to opposite ends of said hollow cylindrical member; a handle; a shaft extending through aligned openings in said first flange element and in said cylinder wall; means restraining said shaft against longitudinal movement through said openings; means securing said handle to said shaft; anchor means on one of said flange elements adapted to engage a second end of the elongated member when the elongated member is wound around said hollow cylindrical member, said anchor means being spaced from said hollow cylindrical member.

2. The combination called for in claim 1, said hollow cylindrical member comprising; hollow cylindrical segments positioned in abutting relation to form a hollow cylindrical member.

3. The combination called for in claim 2, said first flange element and one of said hollow cylindrical segments being of integral construction, said shaft extending through said first flange and through the hollow cylindrical segment secured thereto and being anchored into another hollow cylindrical segment secured to said second flange.

4. The combination called for in claim 1, with the addition of a rib on said cylinder wall adjacent said passage, said rib extending into said central bore.

5. The combination called for in claim 1, said shaft comprising a screw having threads formed on one end thereof and having a head formed on the other end thereof; said means securing said handle to said shaft comprising a sleeve secured to said handle, said screw extending through said sleeve.

6. The combination called for in claim 1, said anchor means on one of said flange elements adapted to engage a second end of the elongated member comprising: an aperture extending through one of said flange elements, the second end of elongated member being positionable through said aperture.

7. The combination called for in claim 1, said first and second flange elements comprising first and second circular discs.

8. The combination called for in claim 7, said anchor means comprising: a plurality of apertures formed in one of said circular discs, said apertures being spaced circumferentially about the periphery of the circular disc.

9. The combination called for in claim 7, said anchor means comprising: a plurality of apertures formed in each of said first and second cylindrical discs, apertures in each of said discs being circumferentially spaced about the periphery of the discs, said apertures formed in said first circular disc being spaced circumferentially relative to said apertures formed in said second circular disc.

10. A reel onto which an elongated member is wound comprising: a hollow cylindrical member having a cylinder wall and a central bore, said hollow cylindrical member having a passage formed in the cylinder wall, said passage communicating with said central bore, a first end of the elongated member being positionable through said passage; first and second circular discs secured to opposite ends of said hollow cylindrical member; a plurality of apertures formed in each of said first and second circular discs, apertures in each of said discs being circumferentially spaced about the periphery of the discs, said apertures formed in said first circular disc being spaced circumferentially relative to said apertures formed in said second circular disc; first and second handles; a first shaft; means securing said first shaft to said first handle, said shaft extending through aligned openings formed in said disc and through said cylinder wall; a second shaft; means rotatably securing said second shaft to said second handle, said second shaft extending through aligned openings extending through said second circular disc and through said cylinder wall, said openings in said cylinder wall through which said first and second shafts extend being diametrically spaced about said hollow cylindrical member.

11. The combination called for in claim 10, said hollow cylindrical member comprising: a pair of segments positioned in abutting relation, said first shaft and second shaft securing said segments together to form the hollow cylindrical member.

12. The combination called for in claim 10, said first and second handles being radially spaced approximately one-third the distance between the central axis of said first and second circular discs and the outer periphery of said first and second circular discs to facilitate rotation of said discs.

13. A reel onto which an elongated member is wound comprising: a pair of segments positioned in abutting relation to form a hollow cylindrical member having a cylinder wall and a central bore, said hollow cylindrical member having an elongated slot formed in the cylinder wall, said slot communicating with said central bore, a first end of the elongated member being positionable through said slot; wedge-shaped ribs secured to said cylinder wall adjacent each side of said slot, said ribs extending into said central bore; first and second circular discs; means securing said first and second circular discs to opposite ends of said hollow cylindrical member, each of said first and second circular discs having a plurality of apertures circumferentially spaced about the outer periphery thereof, said apertures formed through said first circular disc circumferentially spaced relative to apertures formed through said second circular disc, a second end of the elongated member being positionable through one of said apertures when the elongated member is wound around said hollow cylindrical member; a first shaft extending through aligned openings formed in said first cylindrical disc and through said cylinder wall; a first handle; sleeve means rotatably securing said first handle to an end of said first shaft; a second shaft extending through aligned openings in said second circular disc and through said cylinder wall; a second handle; and sleeve means securing said second handle to an end of said second shaft, said first and second shafts being diametrically positioned about said hollow cylindrical member, said first handle extending outwardly from said first circular disc and said second handle extending outwardly from said second circular disc.

14. The combination called for in claim 13, said first and second shafts comprising: lag screws having heads engaging ends of said sleeve means and having ends threadedly engaging each of said segments of the hollow cylindrical member.

15. A reel onto which an elongated member is wound comprising: a cylindrical member; means to detachably secure a first end of the elongated member relative to said cylindrical member; first and second circular flange elements secured to opposite ends of said cylindrical member; anchor means circumferentially spaced about the periphery of each of said circular flange elements, said anchor means being adapted to engage a second end of the elongated member when the elongated member is wound around said cylindrical member, each of said anchor means being equidistant radially from a central axis of said cylidrical member; a pair of handles; a pair of shafts, each of said shafts extending through an opening in one of said flanges and being anchored in said cylindrical member; and means securing one of said handles to each shaft, each shaft being radially spaced approximately one-third the distance between the central axis of the cylindrical member and the outer periphery of said first and second circular flanges.

* * * * *